US007988494B2

(12) United States Patent
Lee

(10) Patent No.: US 7,988,494 B2
(45) Date of Patent: Aug. 2, 2011

(54) EXTENSION CORD LOCK AND IN LINE TAP

(75) Inventor: Dominic Kan Nam Lee, Sha Tin (CN)

(73) Assignee: Multiway Industries (HK) Ltd., Tsuen Wan, Hong Kong (CN)

( * ) Notice: Subject to any disclaimer, the term of this patent is extended or adjusted under 35 U.S.C. 154(b) by 22 days.

(21) Appl. No.: 12/551,913

(22) Filed: Sep. 1, 2009

(65) Prior Publication Data

US 2010/0022106 A1 Jan. 28, 2010

Related U.S. Application Data

(63) Continuation-in-part of application No. 12/231,508, filed on Sep. 3, 2008, now Pat. No. 7,862,385.

(60) Provisional application No. 60/967,337, filed on Sep. 4, 2007.

(51) Int. Cl.
*H01R 25/00* (2006.01)

(52) U.S. Cl. ..... 439/652

(58) Field of Classification Search ..... 439/652, 439/369, 654, 535; 248/65, 71, 73; 24/487, 24/510; 174/53
See application file for complete search history.

(56) References Cited

U.S. PATENT DOCUMENTS

| | | | |
|---|---|---|---|
| 1,935,771 | A | 11/1933 | Feurstein et al. |
| D126,590 | S | 4/1941 | Lewin |
| D164,338 | S | 8/1951 | Tyler |
| D179,081 | S | 10/1956 | Hudson |
| 3,290,453 | A | 12/1966 | Jensen |
| 3,383,639 | A | 5/1968 | Anderson et al. |
| 3,520,988 | A | 7/1970 | Ballock, Sr. |
| 3,609,638 | A | 9/1971 | Darrey |
| 3,781,761 | A | 12/1973 | Harwood |
| 3,922,055 | A | 11/1975 | McGregor |
| 3,924,914 | A | 12/1975 | Banner |
| 4,083,621 | A | 4/1978 | Davidson et al. |
| 4,095,871 | A | 6/1978 | Holte |
| 4,118,690 | A | 10/1978 | Paynton |
| 4,123,012 | A | 10/1978 | Hough |
| D251,293 | S | 3/1979 | Trueblood |
| 4,183,603 | A | 1/1980 | Donarummo |

(Continued)

FOREIGN PATENT DOCUMENTS

DE 33 43 233 6/1985

OTHER PUBLICATIONS

U.S. Appl. No. 12/649,465, filed Dec. 30, 2009, Lee.

(Continued)

*Primary Examiner* — Alexander Gilman
(74) *Attorney, Agent, or Firm* — Frost Brown Todd LLC

(57) ABSTRACT

An electrical, circuit breaker protected, extension cord in-line tap, securement device for securing tandemly connected electrical extension cords. The securement device includes opposing proximal and distal open-ended hook members each having a hinged locking flap for receiving therein a looped end of the associated extension cord thereby preventing unintended separation of the extension cords. The hook members may comprise a back wall having a plurality of vertical ribs along at least a portion of the back wall. The vertical ribs may be configured to grippingly secure the extension cords. Embodiments of the in-line tap may also include a plurality of circuit breaker protected auxiliary electrical outlets on opposing sides for powering additional extension cords or electrical devices.

20 Claims, 19 Drawing Sheets

U.S. PATENT DOCUMENTS 4,500,150 A 2/1985 Leibensperger et al.
4,504,106 A 3/1985 Fechter
D285,552 S 9/1986 Schwartz
D285,788 S 9/1986 Rapp et al.
4,610,494 A 9/1986 Schauber
4,659,161 A 4/1987 Holcomb
4,669,688 A * 6/1987 Itoh et al. ..... 248/74.2
4,671,597 A 6/1987 Grill
D294,487 S 3/1988 Bannigan
4,764,128 A 8/1988 Cheng
4,778,125 A 10/1988 Hu
D301,576 S 6/1989 Wang
D315,141 S 3/1991 Hames
5,004,435 A 4/1991 Jammet
5,071,367 A 12/1991 Luu
D325,723 S 4/1992 Gary et al.
D327,873 S 7/1992 Luu
5,207,594 A 5/1993 Olson
5,255,866 A 10/1993 Campolo
5,336,106 A 8/1994 Osten
D350,940 S 9/1994 Rossman et al.
5,390,876 A * 2/1995 Hatano et al. ..... 248/73
D357,460 S 4/1995 Lovett
5,409,397 A 4/1995 Karman
5,423,693 A 6/1995 Light
5,443,400 A 8/1995 Brown et al.
5,514,004 A 5/1996 Swanson
D372,702 S 8/1996 Sanner
5,562,488 A 10/1996 Neiser et al.
5,582,524 A 12/1996 Sanner et al.
D389,459 S 1/1998 Byrne
D397,086 S 8/1998 Lin
5,795,168 A 8/1998 Duhe
D400,175 S 10/1998 Okamoto
5,888,105 A 3/1999 Brown et al.
D408,355 S 4/1999 Welsh et al.
D409,146 S 5/1999 Fladung
5,931,702 A * 8/1999 Fladung ..... 439/652
D415,105 S 10/1999 Lee
6,004,157 A 12/1999 Glass
D425,638 S 5/2000 Yuen
6,056,580 A 5/2000 Cross et al.
D436,345 S 1/2001 Lentine
6,179,665 B1 1/2001 Rossman et al.
D440,203 S 4/2001 Ewing et al.
D446,502 S 8/2001 Wen
6,443,409 B1 * 9/2002 Zanzucchi ..... 248/218.3
D486,126 S 2/2004 Aromin
D487,726 S 3/2004 Okuda
D493,426 S 7/2004 Strayer
6,929,514 B1 * 8/2005 Chuang ..... 439/652
D540,257 S 4/2007 Ivanova et al.
D549,650 S 8/2007 Russell et al.
D559,184 S 1/2008 Russell et al.
D562,240 S 2/2008 Lee
7,371,121 B1 5/2008 Lee
D577,679 S 9/2008 Lee
D599,290 S 9/2009 Lee

OTHER PUBLICATIONS

U.S. Appl. No. 29/313,368, filed Dec. 30, 2008, Lee.

* cited by examiner

EXTENSION CORD LOCK AND IN LINE TAP

PRIORITY

This application is a continuation-in-part of U.S. Nonprovisional patent application Ser. No. 12/231,508, entitled Extension Cord Lock and In Line Tap, filed Sep. 3, 2008, the disclosure of which is hereby incorporated by reference herein in its entirety, which claims the benefit of U.S. Provisional Patent Application Ser. No. 60/967,337, entitled Extension Cord Lock and In Line Tap, filed Sep. 4, 2007, the disclosure of which is hereby incorporated by reference herein in its entirety.

BACKGROUND

Embodiments of the present invention generally relate to an electrical extension cord accessory. More particularly, embodiments of the present invention teach an improved extension cord coupling device for tandemly connecting two separate extension cords together in a manner to prevent the extension cords from being uncoupled by application of an unintentionally applied tensile force.

Hand held electrically powered tools may have a relatively short power cord that severely limits the range within which such tools may be used. As a result, a user may employ an electrical extension cord to increase the distance from a power source to the power tool being used. However, the typical male/female connectors, when coupled together, may, unintentionally, pull apart, thereby interrupting the electrical power supply to the tool in use. As a preventative measure, the tool user may tie the two cords together, in some manner, thereby preventing unintentional separation of the cord coupling. However, such a practice may place an undesired stress, and/or strain upon the cord in the knotted area.

Further, a user may desire to attach an additional electrical accessory to the power supplying electrical extension cord such as a light, for night work, to illuminate the work area.

Heretofore many devices have been proposed for connecting two electrical cords together in a manner to relieve undue stress and/or strain upon the extension cord material.

One such device is taught in U.S. Pat. No. 5,582,524 issued to Sanner et al., entitled "Cord Lock" on Dec. 10, 1996. Although the Sanner et al. device may relieve the stress and/or strain from two tandemly connected electrical extension cords it is relatively complex to use. The Sanner et al. device requires the user to first form a loop of the extension cord, pass the looped portion of the extension cord through an elongated eyelet and hook the looped portion of the extension cord upon a hook member.

A similar device is taught in U.S. Pat. No. 5,931,702 issued to Fladung, entitled "Electrical Outlet In Line Tap," on Aug. 3, 1999. Although the Fladung device may also relieve the stress and/or strain from two tandemly connected electrical extension cords it is also relatively complex to use. The Fladung device also requires first forming a loop of the extension cord, inserting the looped portion of the extension cord through an elongated eyelet. A rotating post like assembly, hingedly attached to the top of the eyelet, must then be rotated downward through the looped portion of the extension cord that protrudes through the eyelet.

While numerous devices and methods have been made and used to connect two electrical cords together in a manner to relieve undue stress and/or strain upon the extension cord material, it is believed that no one prior to the inventors has made or used the invention described in the appended claims.

BRIEF SUMMARY

Embodiments of the present invention comprise a simplified and improved in-line tap coupling for tandemly connecting a pair of electrical extension cords that prevents unintentional separation of the male/female extension cord connectors.

In one embodiment, the improved in-line tap coupling comprises a main body having an electrical input connector comprising a typical male type pin and spade connector means at the main body's proximal end for receiving the female connector of a first extension cord. A female connector means for receiving the male connector of a second extension cord is provided at its distal end. Extending laterally from the opposing sides of the main body are multiple female outlet connectors for receiving therein the male connectors of additional extension cords or power cords connected directly to electrical devices. A resettable circuit breaker is electrically placed between the input male connector and the female outlet connectors.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

DETAILED DESCRIPTION

Figure 1:
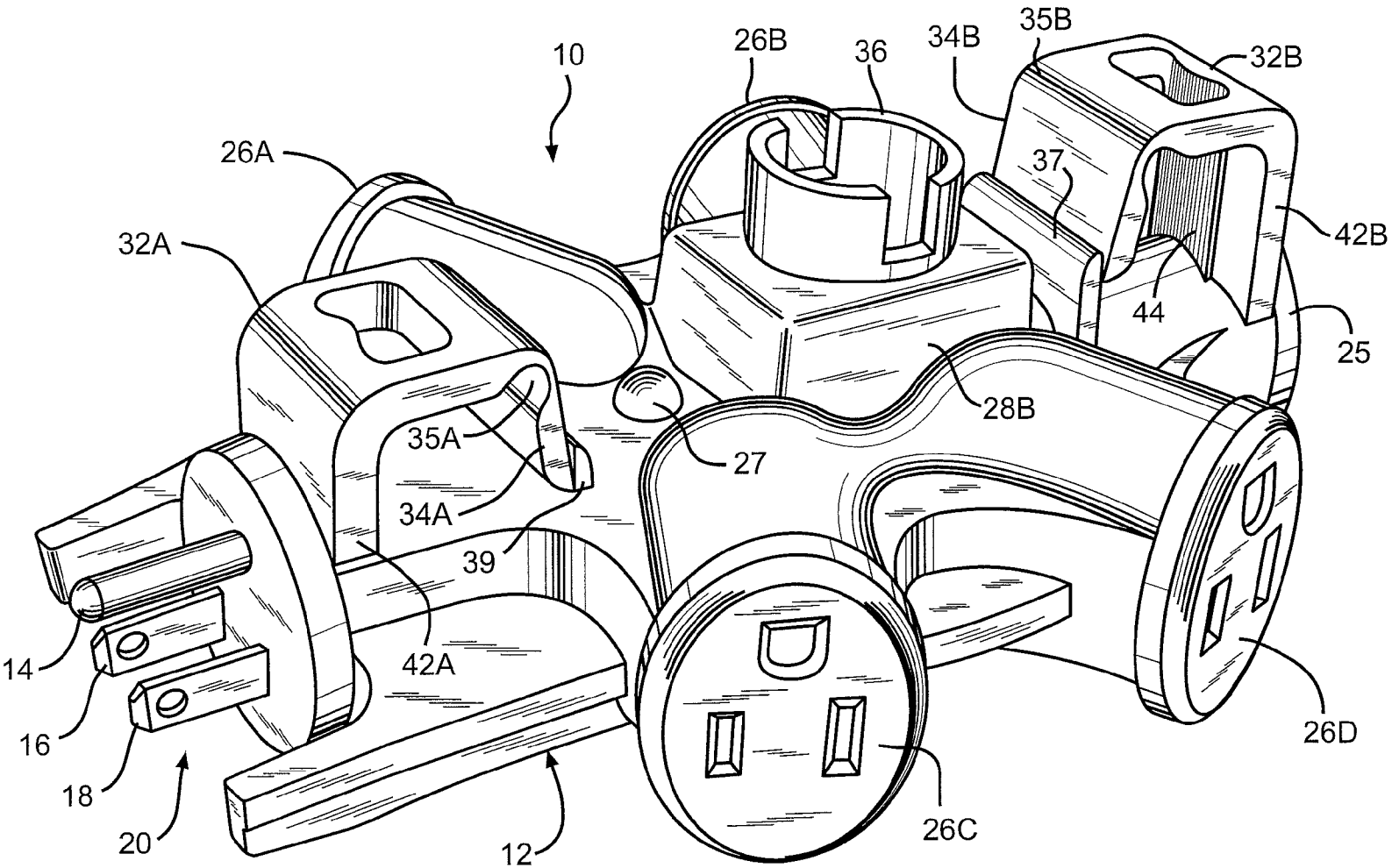
FIG. 1 presents a perspective view of an exemplary in-line tap.
Figure 2:
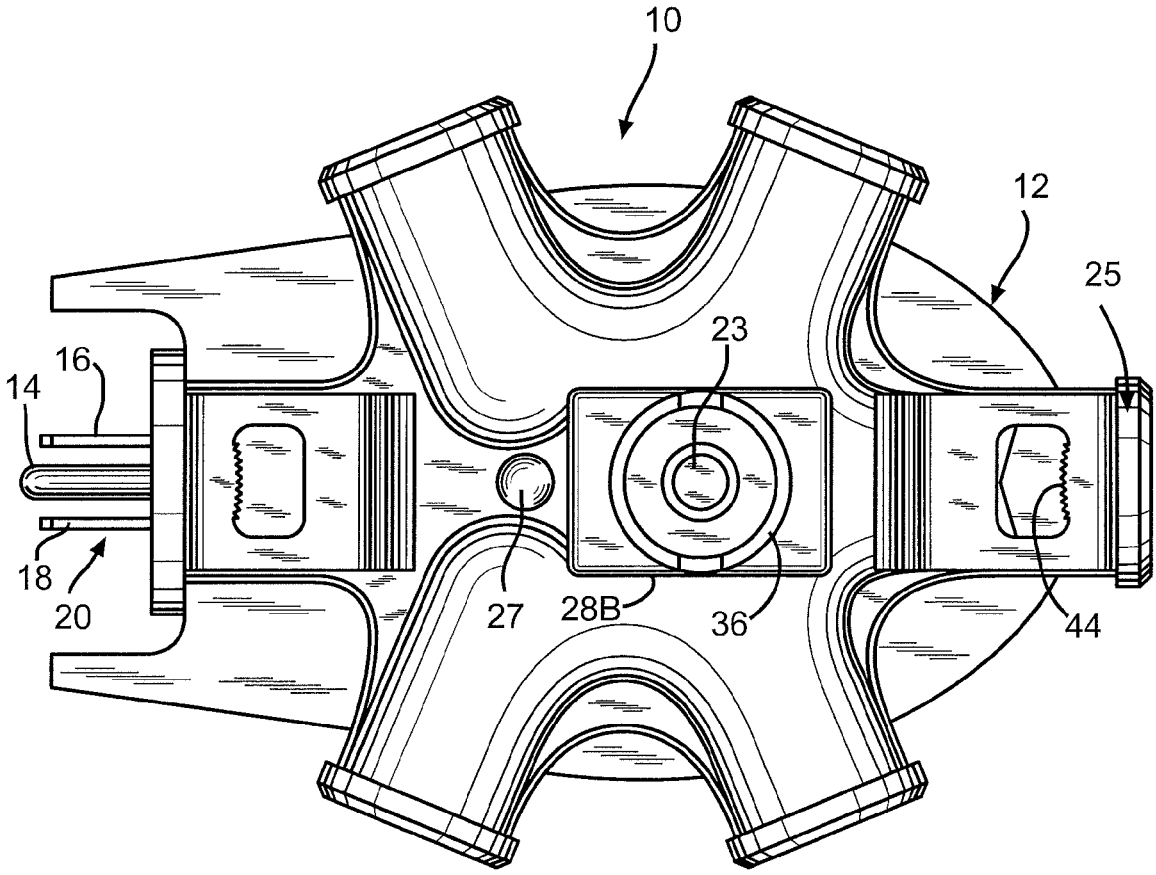
FIG. 2 presents a top plan view of the in-line tap of FIG. 1.
Figure 3:
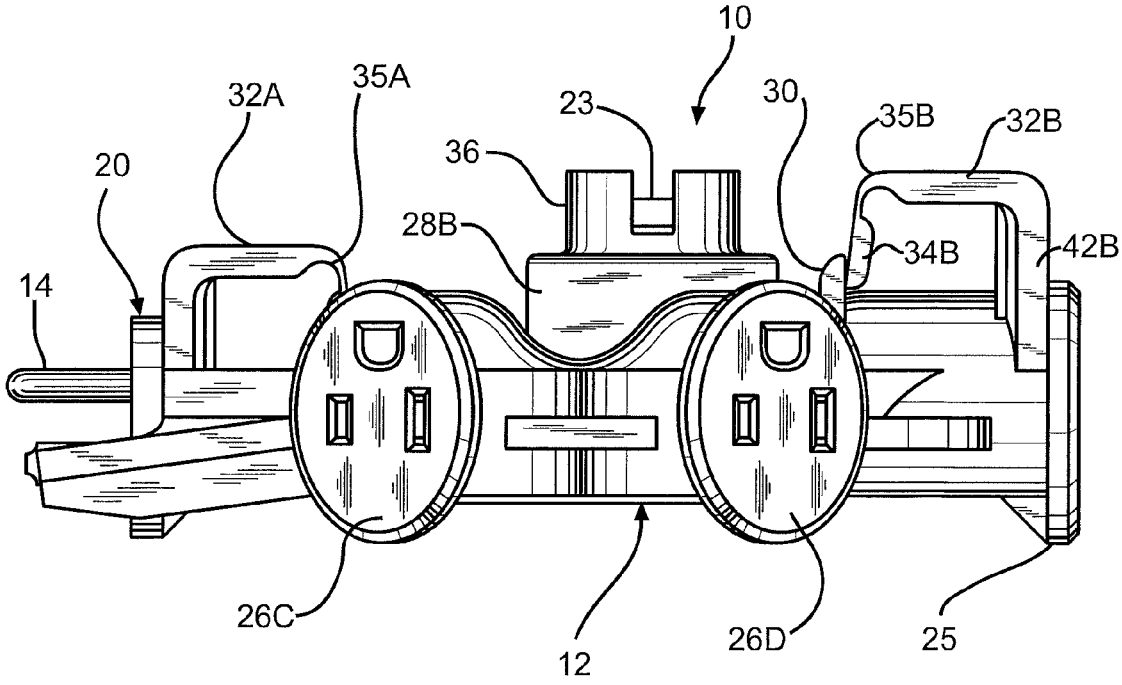
FIG. 3 presents a left side elevational view of the in-line tap of FIG. 1.
Figure 4:
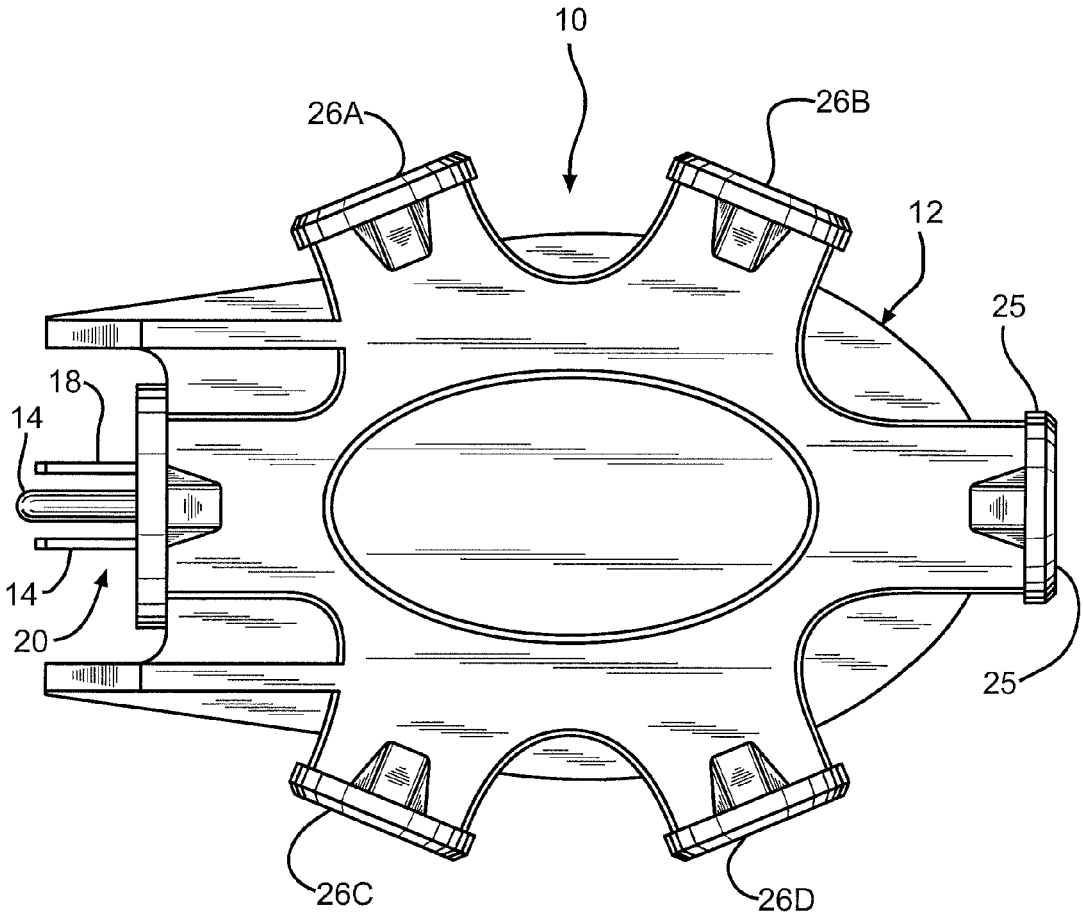
FIG. 4 presents a bottom view of the in-line tap of FIG. 1.
Figure 5:
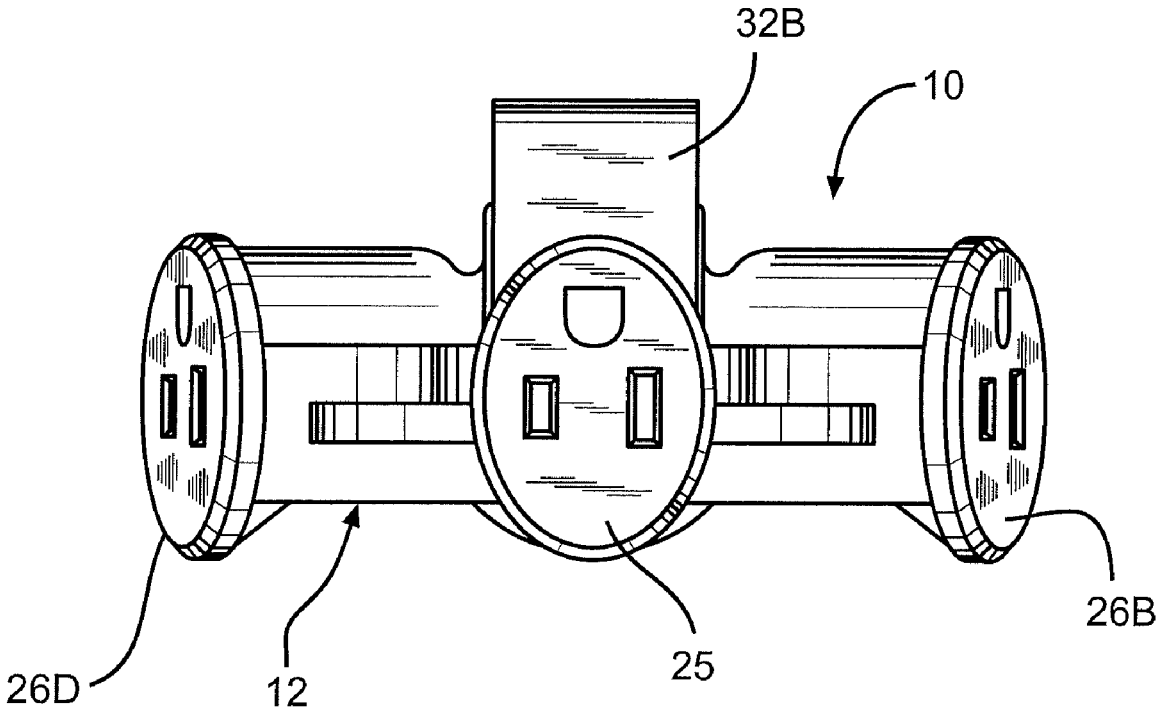
FIG. 5 presents a rear elevational view of the in-line tap of FIG. 1.
Figure 6:
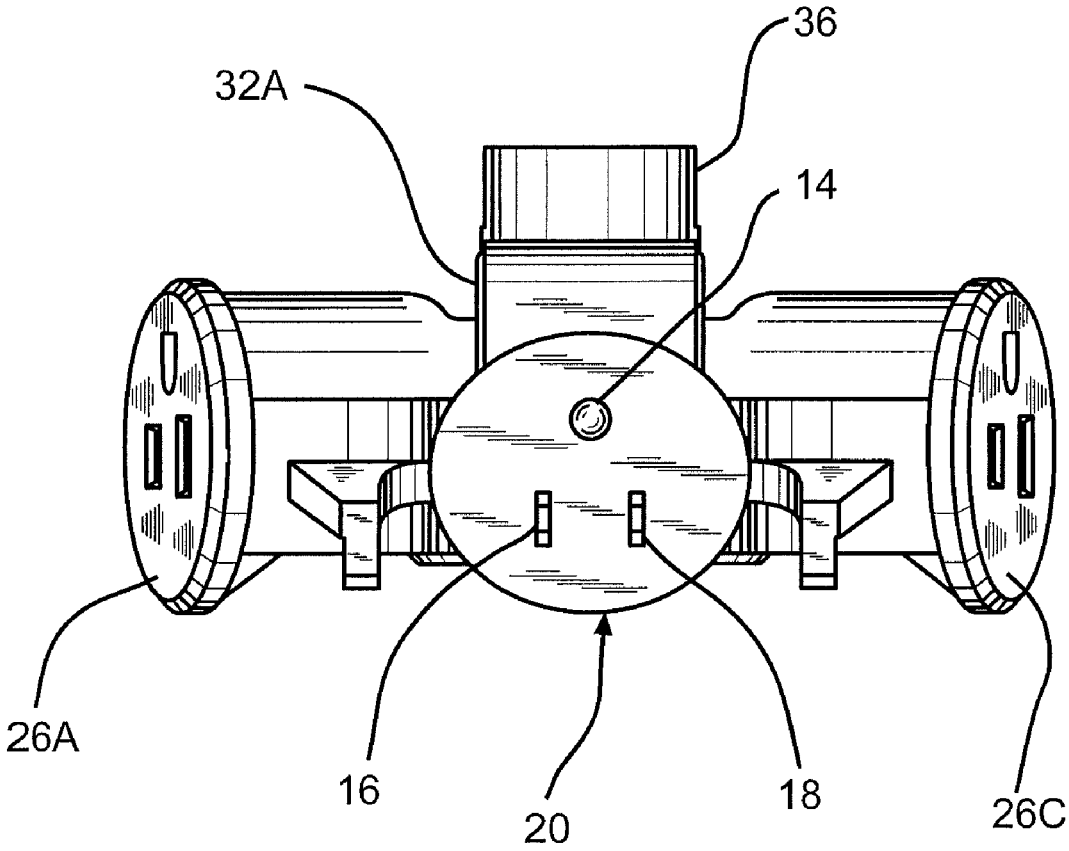
FIG. 6 presents a front elevational view of the in-line tap illustrated in FIG. 1.
Figure 7:
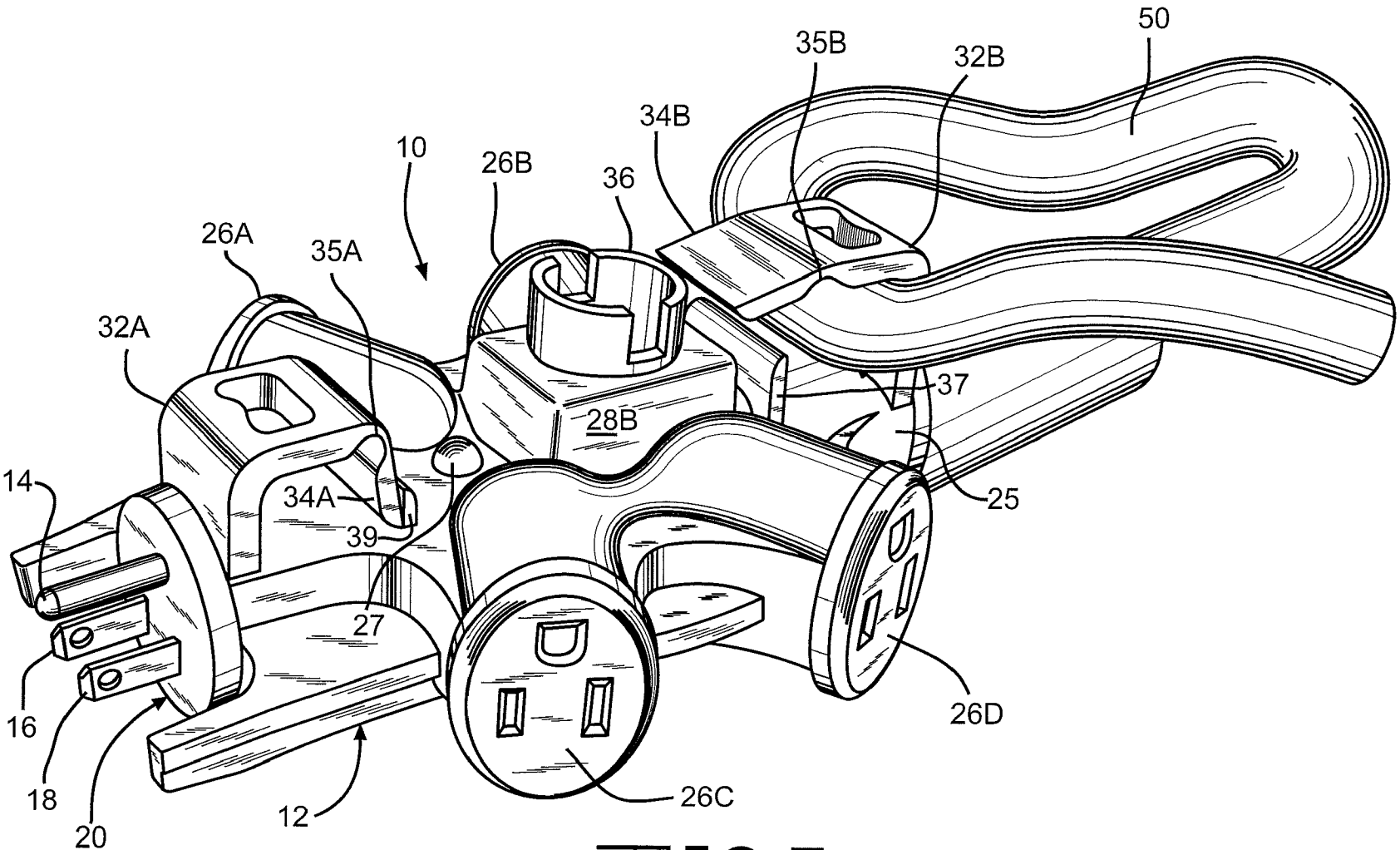
FIGS. 7 through 9 present a pictorial sequence of connecting two extension cords with the in-line tap of FIG. 1.
Figure 8:
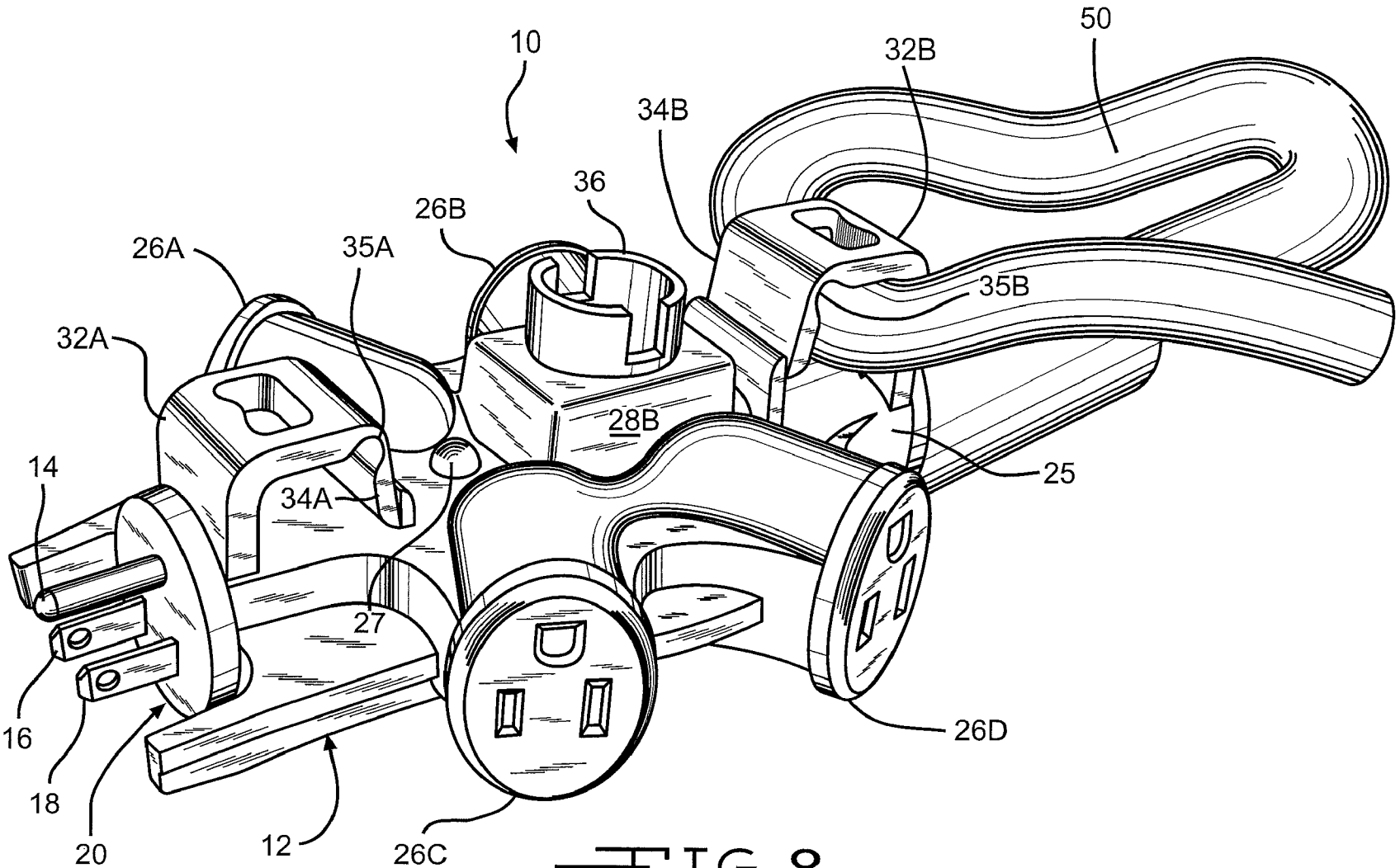
Figure 9:
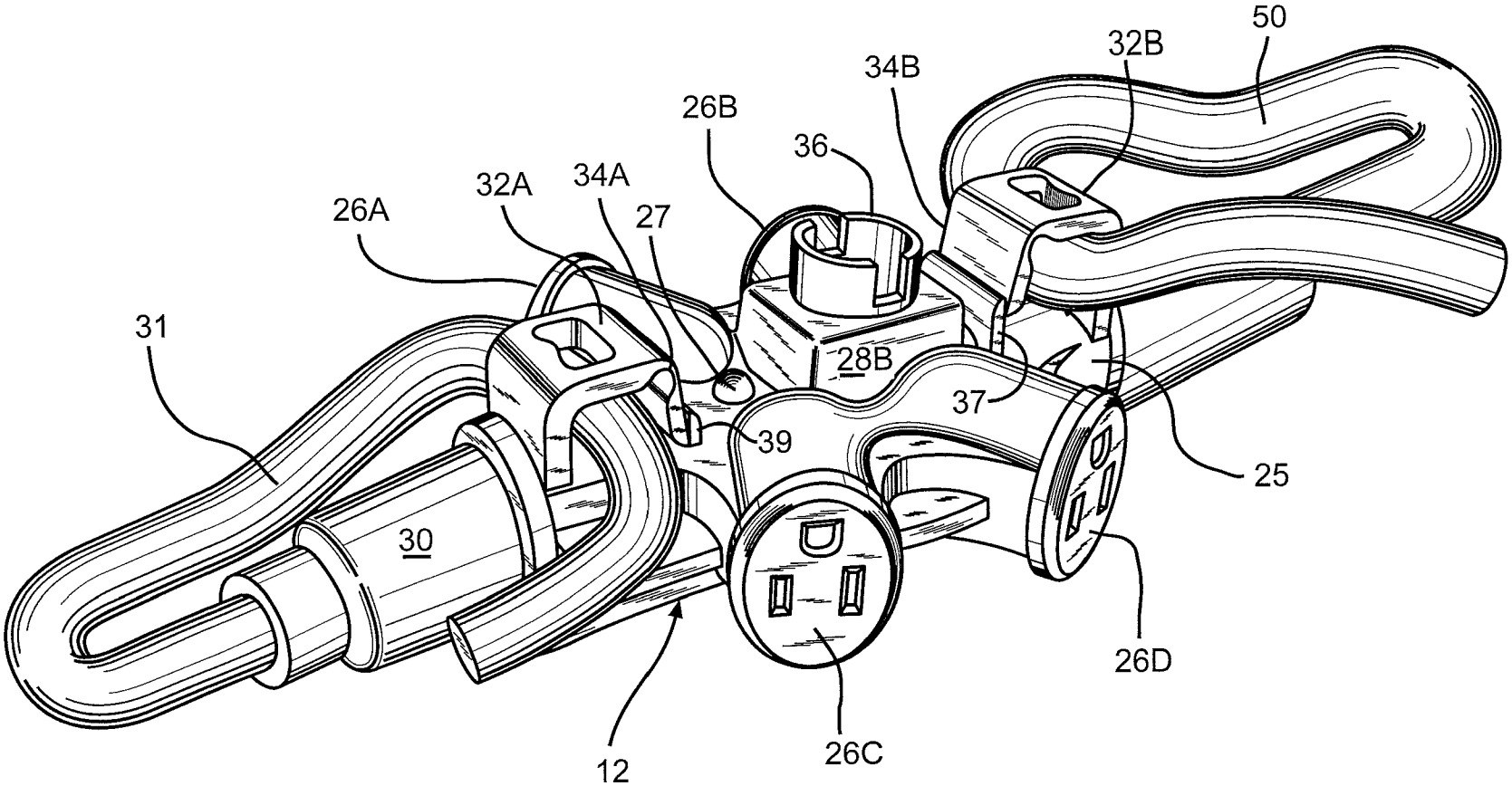

In the embodiment shown in FIGS. 1 through 9, in-line tap 10 comprises a main body assembly 12 having a typical male electrical input connector 20, at its proximal end, typically comprising a grounding pin 14, a common electrical spade connector 16 and a live, or hot, electrical spade connector 18. A typical female electrical output connector 25 is provided at the distal end of main body 12 for receipt therein of the male electrical spade connectors of the add on electrical extension cord 50 as illustrated in FIGS. 7, 8 and 9.

Integral with main body assembly 12 are four auxiliary female electrical output connectors 26A, 26B, 26C, and 26D for connecting additional add-on electrical extension cords. Of course, the number of auxiliary female electrical output connectors may be varied depending on the intended application(s) for a particular embodiment. An integrated and guarded circuit breaker 28B is provided to prevent an electrical overload on the electrical supply extension cord 31. A vertically extending guard 36 is preferably provided to protect the circuit breaker reset button 23. Main body assembly 12 further comprises a lamp 27 interposed between the male electrical input connector 20 and the female electrical output connector 25. The lamp 27 may comprise a neon lamp or any other device configured to provide a visual indication to an observer. The lamp may be configured to be lighted when in-line tap 10 is electrically powered. The internal structure of main body 12 and the electrical connections are further described below.

Integrally molded into the top of main body 12 are two angular hooks, or eyelets, 32A at its proximal end and 32B at its distal end. Each eyelet includes a hinged closure flap 34A and 34B hinged to its associated eyelet by a "living hinge" 35A and 35B as best illustrated in FIG. 7. Hinge 34A and 34B are secured, when closed by upwardly protruding locking lip 39 and 37 respectively. Preferably the inside surface of back wall 42A and 42B is provided with vertical ribs 44 to grippingly secure the extension cord when locked within eyelets 32A and 32B.

In Operation

Referring now to FIGS. 7, 8, and 9, hinged closure flap 34B is first opened, as illustrated in FIG. 7 (hinged closure flap 34B is in an open position). The male electrical input connector prongs (not shown) of add-on extension cord 50 are inserted into the appropriate electrical output apertures of output connector 25 as illustrated in FIG. 7. Add-on extension cord is looped about back wall 42 of distal eyelet 32B, as illustrated in FIG. 7, and hinged closure flap 34B is then snapped shut, as illustrated in FIG. 8 (hinged closure 34B is in a closed position) thereby securing add-on extension cord 50 therein.

With add-on extension cord 50 locked in place the male electrical input connector prongs 14, 16, and 18 of main body 12 are plugged into the female end 30 of electrical supply extension cord 31 as illustrated in FIG. 9, Electrical supply extension cord 31 is then similarly secured to the proximal eyelet 32A. Extension cords 31 and 50 are now secured one to the other so as not to pull apart.

Electrical Subassembly Structure

FIGS. 10 through 18 illustrate details of the internal, electrical subassembly 100 of the in-line tap 10 illustrated in FIGS. 1 through 9 and described above.

Figure 10:
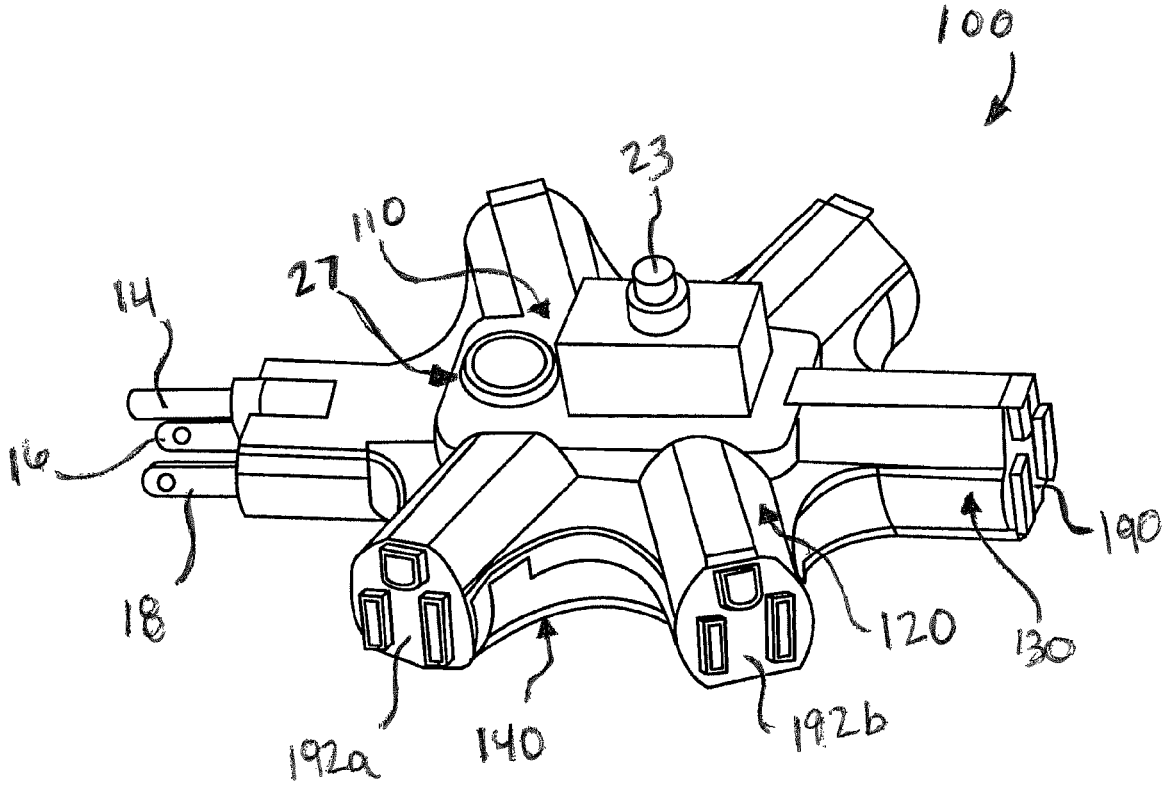
FIG. 10 presents a top pictorial view of the electrical subassembly encapsulated within the in-line-tap of FIG. 1.

FIG. 10 shows a top view of subassembly 100. Subassembly 100 once completed may be fully encapsulated by a molded, unitary, elastomeric covering thereby producing the final in-line tap configuration as illustrated in FIGS. 1 through 9.

Figure 11:
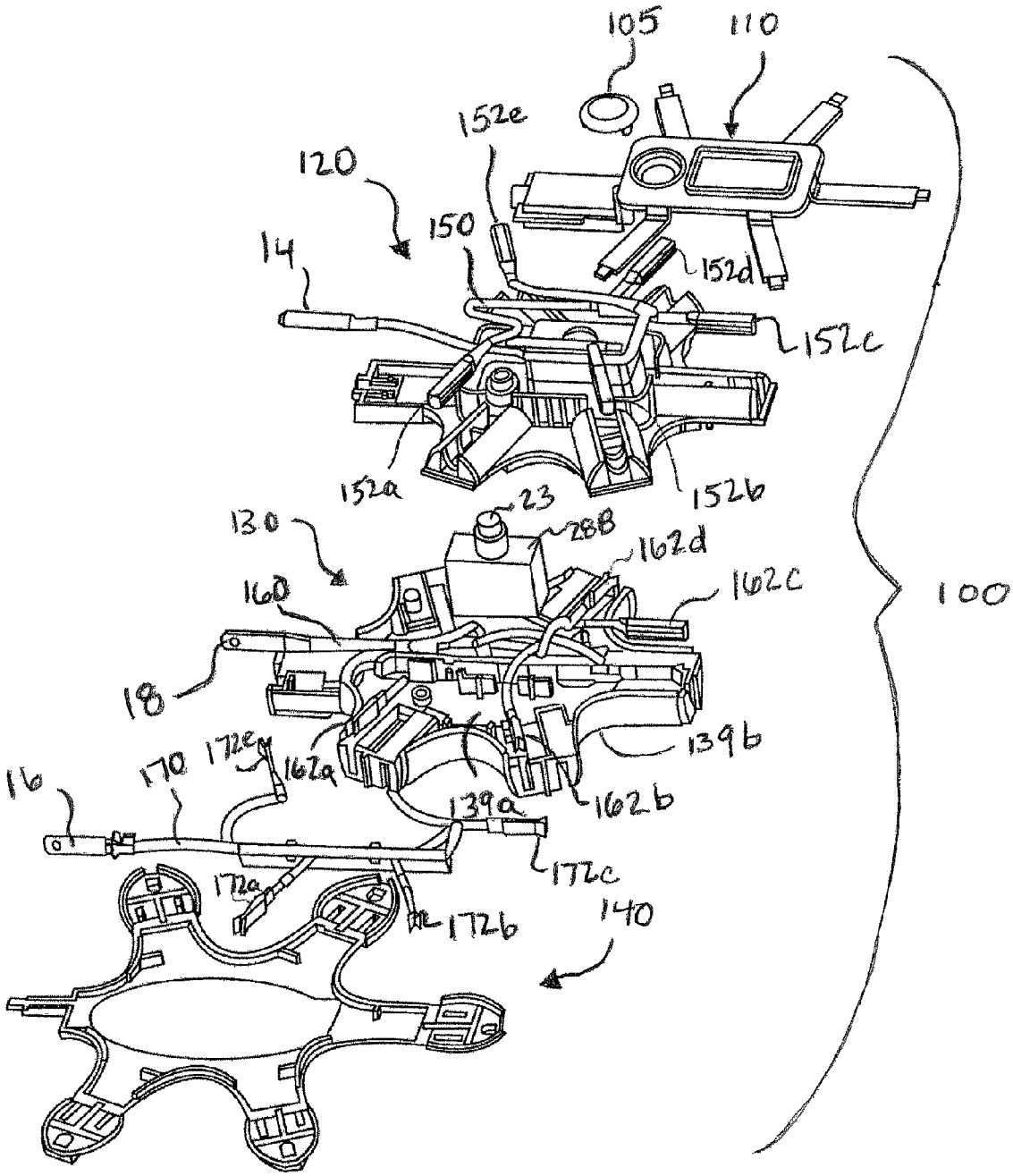
FIG. 11 presents an exploded pictorial view of the electrical subassembly of 10.
Figure 12:
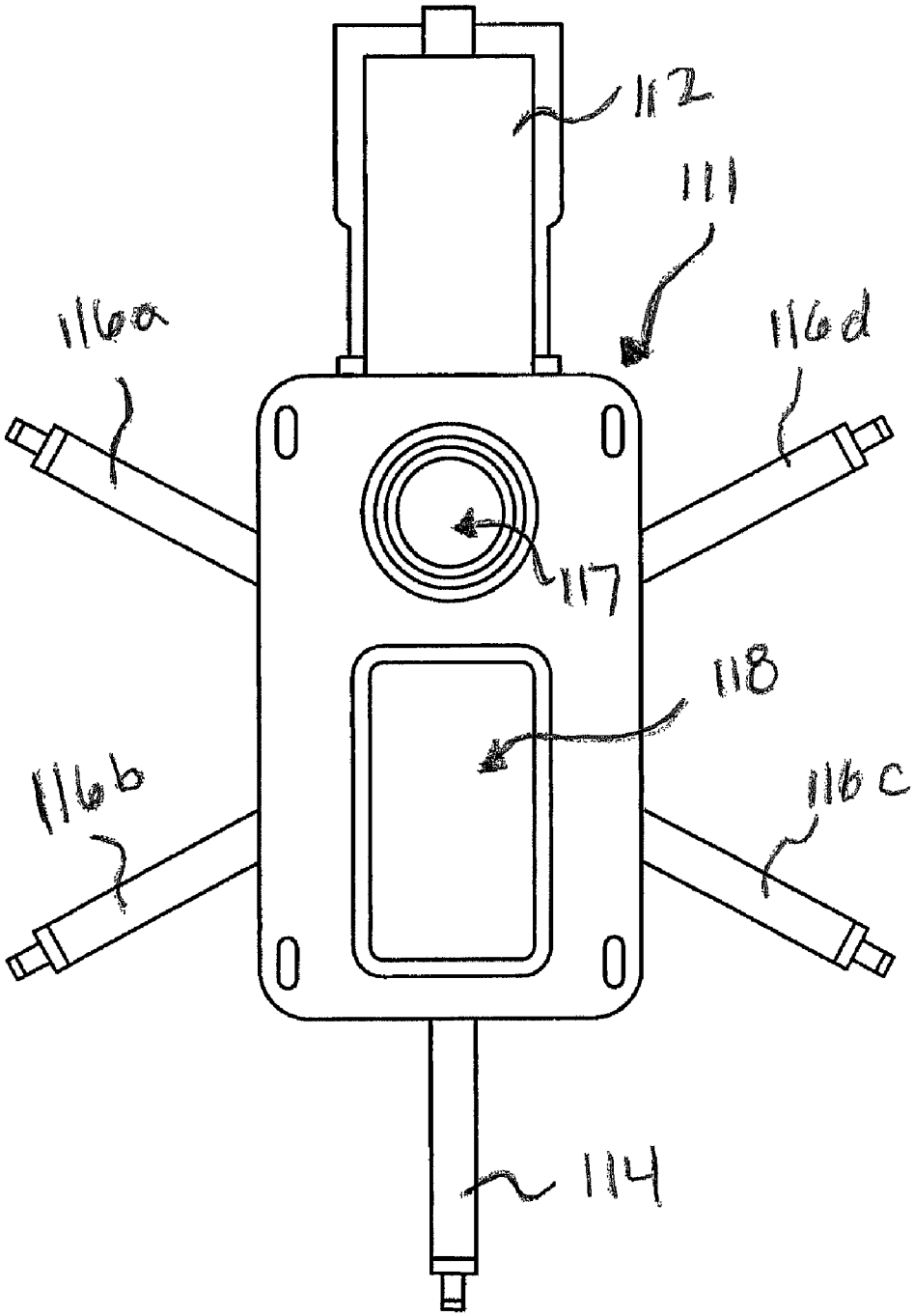
FIG. 12 presents a top plan view of the cover sheet of the electrical subassembly of FIG. 10.
Figure 13:
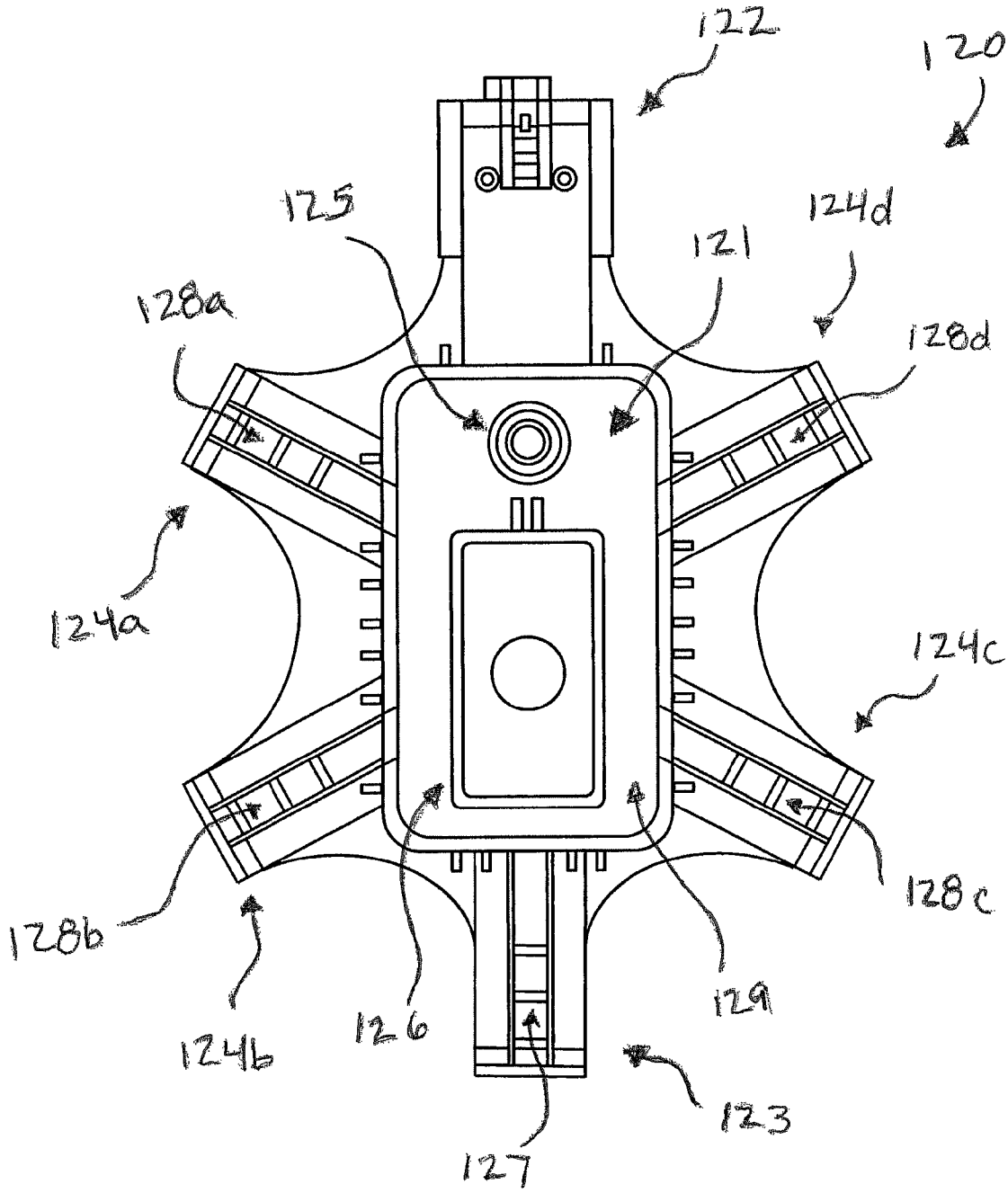
FIG. 13 presents a top plan view of the top cover, without wiring, of the electrical subassembly of FIG. 10.
Figure 14:
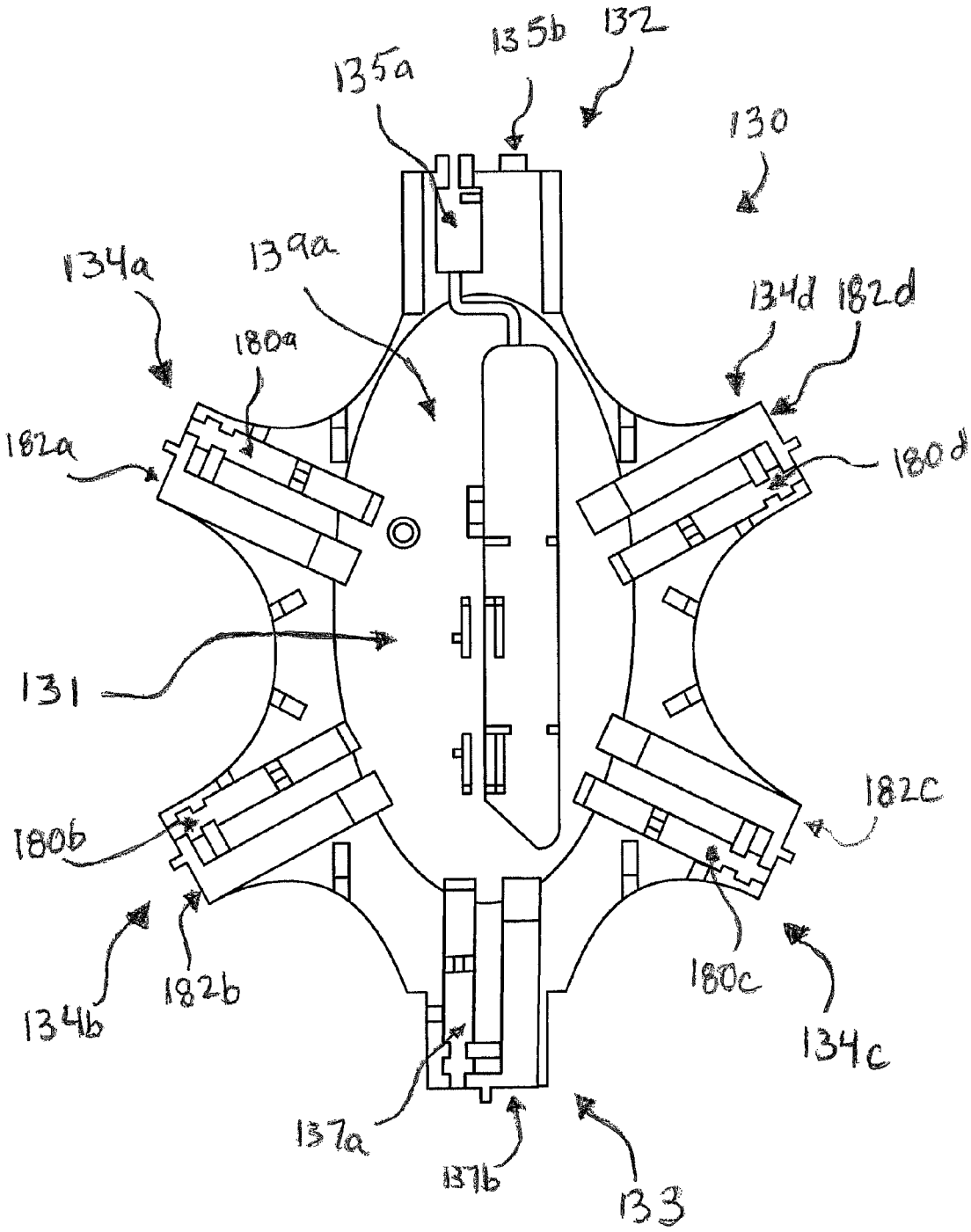
FIG. 14 presents a top plan view of the middle cover, without wiring, of the electrical subassembly of FIG. 10.
Figure 15:
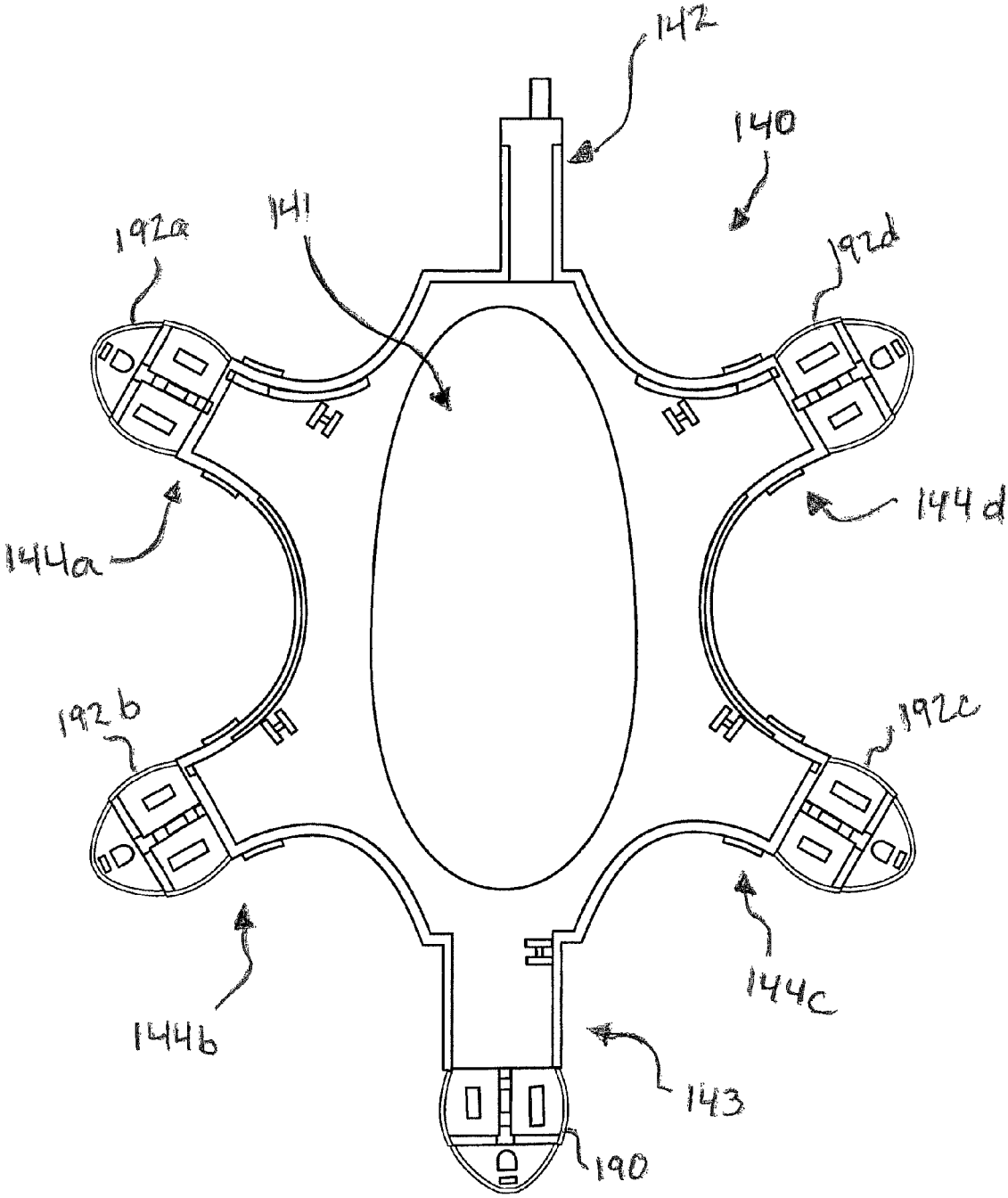
FIG. 15 presents a top plan view of the bottom cover of the electrical subassembly of FIG. 10.

Referring to FIG. 11, subassembly 100 generally comprises a cover sheet 110, a top cover 120, a middle cover 130, and a bottom cover 140. In this version, cover sheet 110 is attached to top cover 120, while middle cover 130 is positioned between top cover 110 and bottom cover 140. The outer contour of each of the components is configured to correspond to the other components and ultimately to allow the cover sheet 110, top cover 120, middle cover 130 and bottom cover 140 to fit securely together to form subassembly 100. The components of subassembly 100 may be configured to provide a snap fit assembly between the components, or, alternatively one or more of the cover sheet 110, top cover 120, middle cover 130, and bottom cover 140 may be assembled using a suitable adhesive, electron beam welding or any other method or device suitable for a particular application of the device.

Figure 17:
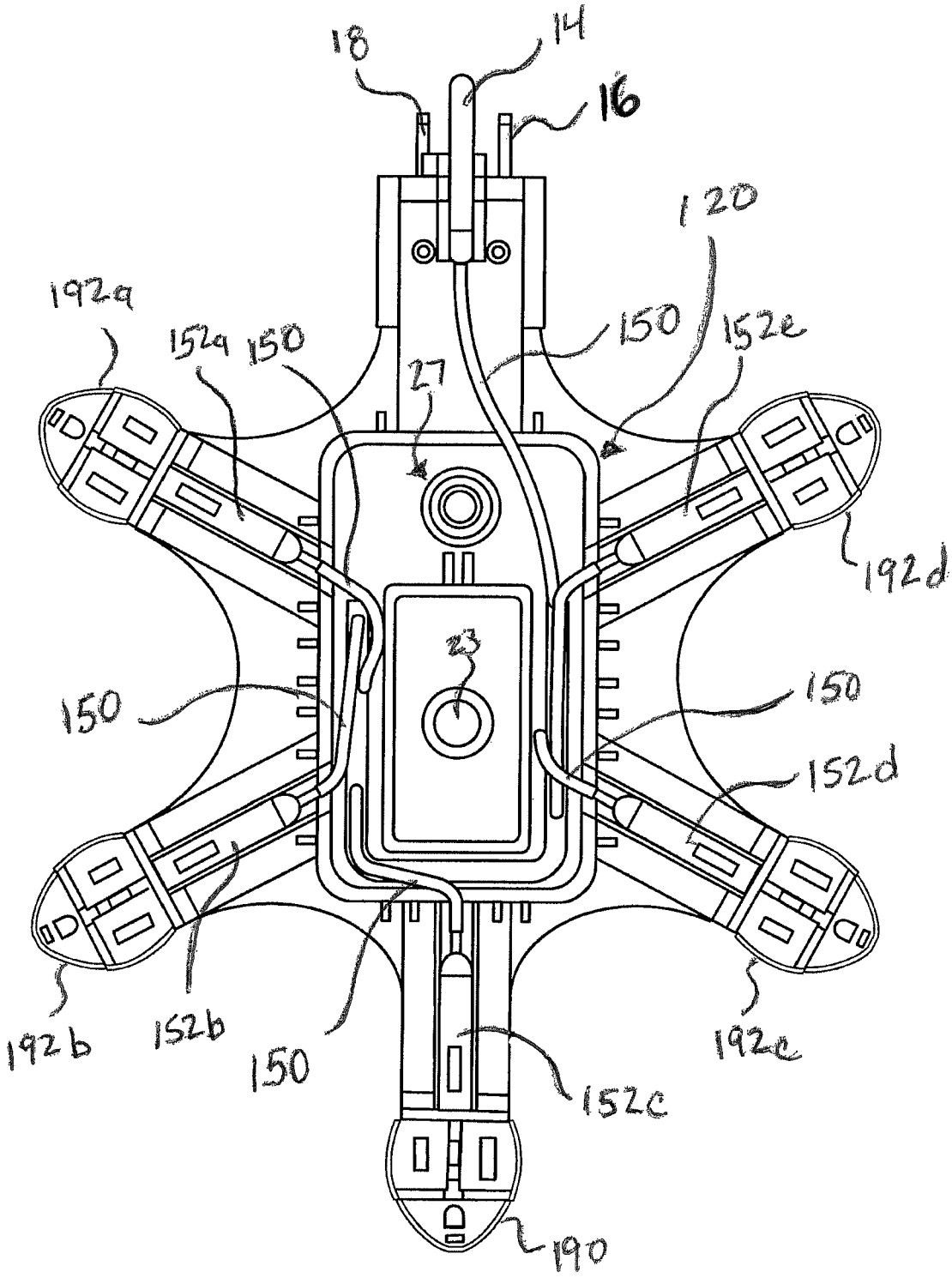
FIG. 17 presents a top plan view of the bottom cover, middle cover, and top cover of the electrical subassembly of FIG. 10 assembled together with wiring in place.

Referring to FIGS. 11 and 17, the electric power distribution circuitry is positioned among the components of subassembly 100 and comprises a grounding busbar wire 150, an active, or hot, busbar wire 160, and a common busbar wire 170. As shown in FIG. 11, grounding busbar wire 150 is positioned within top cover 120 and covered by cover sheet 110. In this example, grounding busbar wire 150 is attached to grounding pin 14, while also being attached to pin electrodes 152*a*, 152*b*, 152*c*, 152*d*, 152*e*. In the illustrated version, active busbar wire 160 is positioned within the upper surface 139*a* of middle cover 130, and a common busbar wire 170 is positioned within the lower surface 139*b* of middle cover 130. As shown, active busbar wire 160 is attached to active electrical spade connector 18 and spade electrodes 162*a*, 162*b*, 162*c*, 162*d*, 162*e*. In this example, common busbar wire 170 is attached to common electrical spade connector 16 and spade electrodes 172*a*, 172*b*, 172*c*, 172, 172*e*.

In the illustrated embodiment, cover sheet 110 comprises a central portion 111, a male input connector member 112, a female output connector member 114, and a plurality of auxiliary female output connector members 116*a*, 116*b*, 116*c*, 116*d*. The central portion 111 further comprises a lamp opening 117 and a circuit breaker opening 118. Lamp opening 117 may be configured to be aligned with lamp 27 once subassembly 100 is fully assembled. Lamp cover 105 may be configured to be attached to lamp opening 117 to shield lamp 27, although lamp cover 105 is not required. Circuit breaker opening 118 may be configured to receive at least a portion of circuit breaker housing 126 in the top cover 120. Male input connector member 112 may be configured to cover at least a portion of the male input connector portion 122 of top cover 120 when cover sheet 110 is assembled together with top cover 120. Similarly, female output connector member 114 may be configured to cover at least a portion of the female output connector portion 123 of top cover 120 when cover sheet 110 is assembled together with top cover 120. In addition, auxiliary female output connector members 116*a*, 116*b*, 116*c*, 116*d* may each be configured to cover at least a portion of a corresponding one of the auxiliary female output connector portions 124*a*, 124*b*, 124*c*, 124*d* of top cover 120 when cover sheet 110 is assembled together with top cover 120.

As shown, top cover 120 comprises a central portion 121, a male input connector portion 122, a female output connector portion 123, and a plurality of auxiliary female output connector portions 124*a*, 124*b*, 124*c*, 124*d*. In the illustrated version, the central portion 121 comprises a lamp opening 125 and a circuit breaker housing 126. Lamp opening 125 may be configured to house lamp 27, while circuit breaker housing 126 may be configured to receive and house at least a portion of circuit breaker 28B. Male input connector portion 122 may be configured to receive grounding pin 14. In this example, female output connector portion 123 comprises a cavity 127 configured to receive pin electrode 152*c*. Similarly, as shown, each auxiliary female output connector portion 124*a*, 124*b*, 124*c*, 124*d* comprises a cavity 128*a*, 128*b*, 128*c*, 128*d* configured to receive a corresponding one of the pin electrodes 152*a*, 152*b*, 152*d*, 152*e*.

Figure 16:
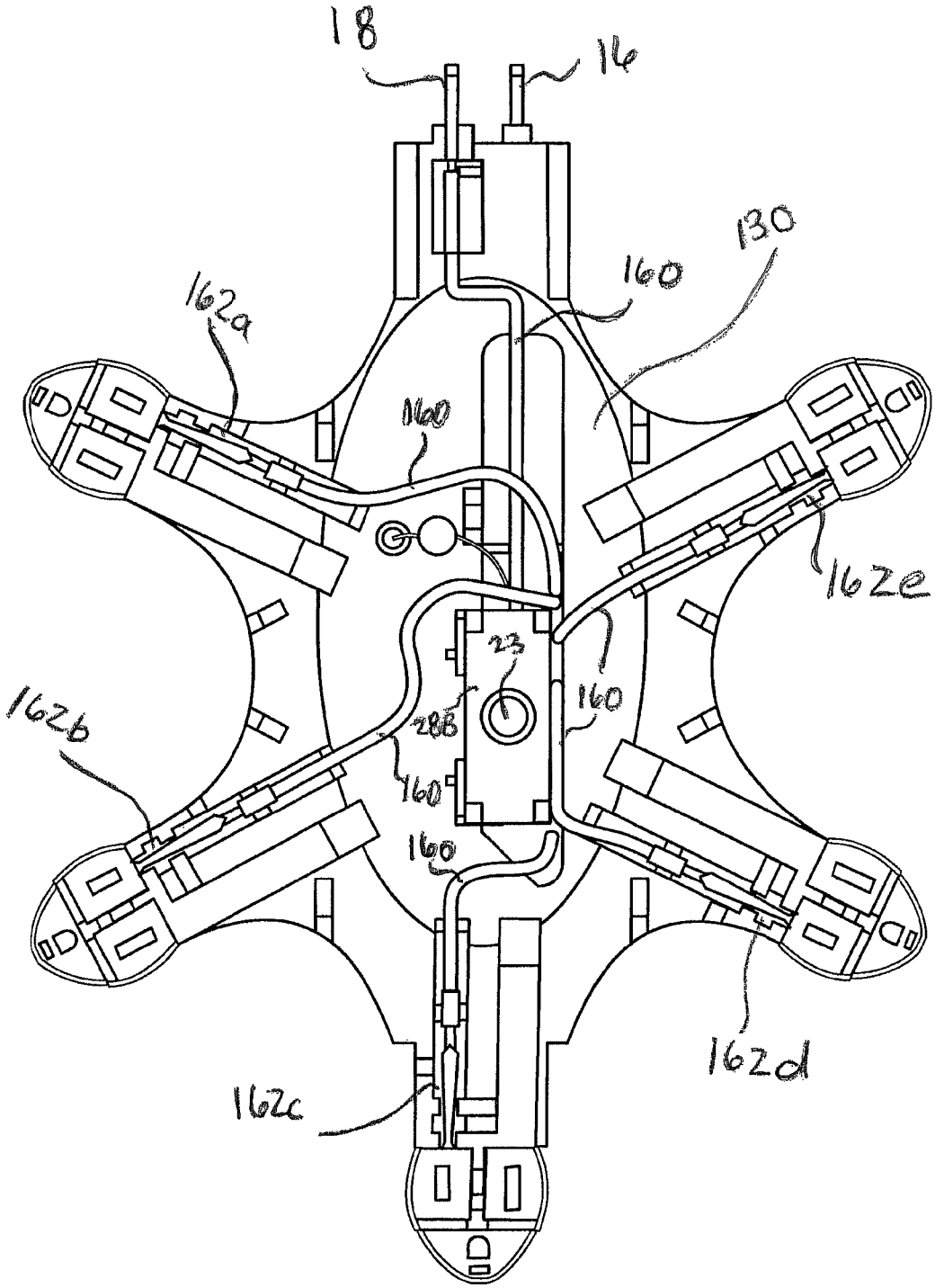
FIG. 16 presents a top plan view of the bottom cover and middle cover of the electrical subassembly of FIG. 10 assembled together with wiring in place.

As shown, middle cover 130 comprises a central portion 131, a male input connector portion 132, a female output connector portion 133, and a plurality of auxiliary female output connector portions 134*a*, 134*b*, 134*c*, 134*d*. As shown in FIG. 16, central portion 131 is configured to support circuit breaker 28B upon assembly. In this version, male input connector portion 132 comprises a pair of cavities 135*a*, 135*b*. Cavity 135*a* may be in communication with upper surface 139*a* and configured to receive live electrical spade connector 18, while cavity 135*b* may be in communication with lower surface 139*b* and configured to receive common electrical spade connector 16. In this example, female output connector portion 133 comprises a pair of cavities 137*a*, 137*b*. Cavity 137*a* may be in communication with upper surface 139*a* and configured to receive spade electrode 162*c*, while cavity 137*b* may be in communication with lower surface 139*b* and configured to receive spade electrode 172*c*. Similarly, as shown, each auxiliary female output connector portion 134*a*, 134*b*, 134*c*, 134*d* comprises a cavity 180*a*, 180*b*, 180*c*, 180*d* in communication with upper surface 139*a* and a cavity 182*a*, 182*b*, 182*c*, 182*d* in communication with lower surface 139*b*. In this embodiment, cavities 180*a*, 180*b*, 180*c*, 180*d* are configured to receive a corresponding one of spade electrodes 162*a*, 162*b*, 162*d*, 162*e* connected to active busbar wire 160. Similarly, in this version, cavities 182*a*, 182*b*, 182*c*, 182*d* are configured to receive a corresponding one of spade electrodes 172*a*, 172*b*, 172*d*, 172*e* connected to common busbar wire 170.

As shown, bottom cover 140 comprises a central portion 141, a male input connector portion 142, a female output connector portion 143, and a plurality of auxiliary female output connector portions 144*a*, 144*b*, 144*c*, 144*d*. In this version, female output connector portion 143 comprises a hinged socket cover 190. Hinged socket cover 190 may be configured to pivot upward and attach to one or more of cover sheet 110, top cover 120, and middle cover 130 to encase female output connector portions 123, 133 between bottom cover 140 and cover sheet 110. Similarly, in this embodiment, each of the auxiliary female output connector portions 144*a*, 144*b*, 144*c*, 144*d* comprise a hinged socket cover 192*a*, 192*b*, 192*c*, 192*d*. Each hinged socket cover 192*a*, 192*b*, 192*c*, 192*d* may be configured to pivot upward and attach to one or more of the cover sheet 110, top cover 120, and middle cover 130 to encase corresponding ones of the auxiliary female output connector portions 124*a*, 124*b*, 124*c*, 124*d*, 134*a*, 134*b*, 134*c*, 134*d* between bottom cover 140 and cover sheet 110.

Collectively, in the illustrated embodiment, pin electrode 152*a* and spade electrodes 162*a*, 172*a* form female auxiliary electrical output connector 26C, pin electrode 152*b* and spade electrodes 162*b*, 172*b* form female auxiliary electrical output connector 26D, pin electrode 152*d* and spade electrodes 162*d*, 172*d* form female auxiliary electrical output connector 26B, and pin electrode 152*e* and spade electrodes 162*e*, 172*e* form female auxiliary electrical output connector 26A. Similarly, in this version, pin electrode 152*c* and spade electrodes 162*c*, 172*c* collectively form female electrical output connector 25.

Figure 17A:
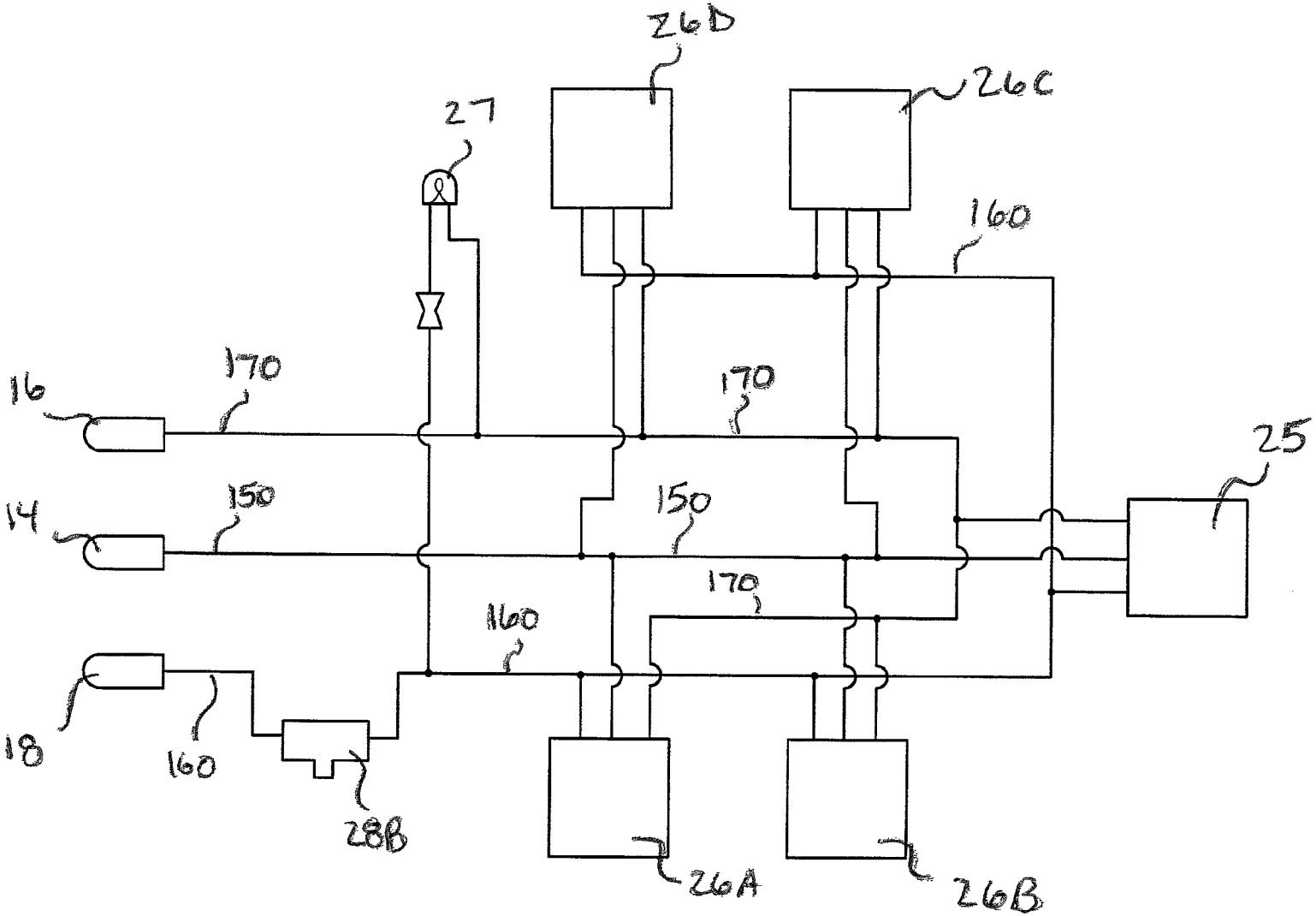
FIG. 17A presents an electrical schematic of the electrical subassembly illustrated in FIG. 10.
Figure 18:
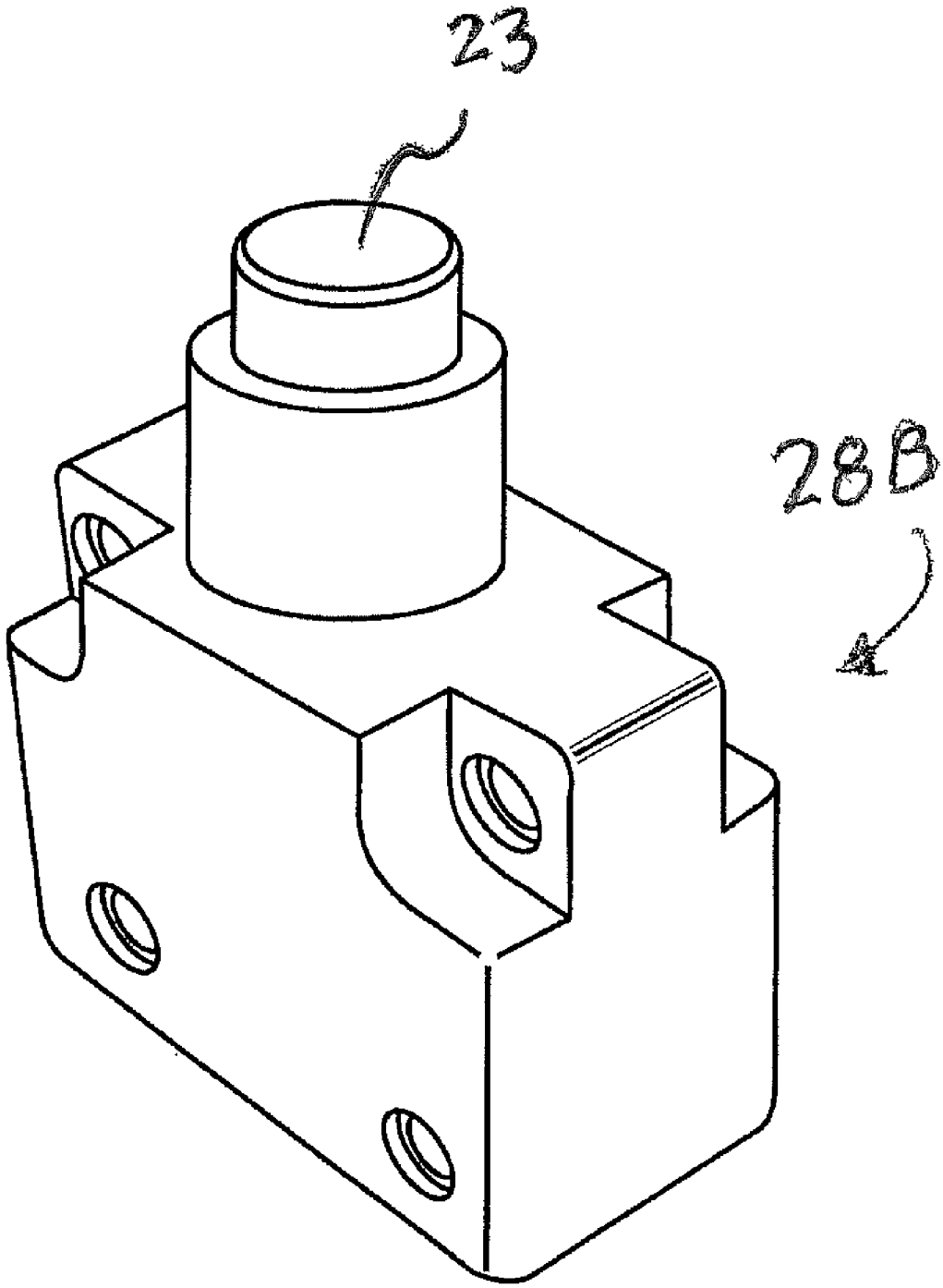
FIG. 18 presents an isolated pictorial view of the circuit breaker incorporated within the electrical subassembly of FIG. 10.

Busbar wires 150, 160, 170 are preferably made of braided copper strands thereby producing a flexible electrical conducting wire, although this is not required. In an alternate embodiment (not shown), busbar wires 150, 160, 170 may comprise flat fabricated brass or copper busbars. In the illustrated embodiment, grounding busbar wire 150 is positioned on the upper surface 129 of central portion 121 of top cover 120, and connecting wires from grounding pin 14 and pin electrodes 152*a*, 152*b*, 152*c*, 152*d*, 152*e* are attached to grounding busbar wire 150. Also in this version, active busbar wire 160 is positioned on the upper surface 139*a* of central portion 131 of middle cover 130, and connecting wires from live electrical spade connector 18 and spade electrodes 162*a*, 162*b*, 162*c*, 162*d*, 162*e* are attached to active busbar wire 160. In addition, as shown, common busbar wire 170 is positioned on the lower surface 139*b* of middle cover 130, and connecting wires from common electrical spade connector 16 and spade electrodes 172*a*, 172*b*, 172*c*, 172*d*, 172*e* are attached to common busbar wire 170. In this way busbar wires 150, 160, 170 do not need to have an insulator covering and may be installed as bare wires separated from one another by the central portions 121, 131 of top cover 120 and middle cover 130. If one or more of busbar wires 150, 160, 170 are installed as bare wires without an insulator covering, then the connecting wires attached to busbar wires 150, 160, 170 may be insulated. Alternatively, both busbar wires 150, 160, 170 and the attachment wires attached thereto may have an insulator covering. FIG. 17A presents a circuit diagram of the subassembly wiring Once subassembly 100 is complete, it is encapsulated within a one piece molded, elastomeric covering as illustrated in FIGS. 1 through 9.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. An electrical extension cord connecting device comprising:

a) a main body member having a proximal end, an opposite distal end, and a longitudinal axis extending between the proximal end and the opposite distal end, wherein the main body comprises 1) male electrical input connectors positioned at the proximal end, and 2) female electrical output connectors positioned at the distal end, wherein the male electrical input connectors positioned at the proximal end of the main body member are in electrical communication with the female electrical output connectors positioned at the distal end of the main body member;

b) a first hook member, wherein the first hook member is positioned adjacent to the proximal end of the main body member, wherein the first hook member comprises
   1) a first open end, wherein the first open end opens toward the distal end of the main body member, and
   2) a first hinged flap, wherein the first hinged flap is operably configured to transition between a closed position and an open position, wherein the first open end of the first hook member is closed when the first hinged flap is in the closed position, wherein when the first hinged flap is in the closed position the first hook member defines a first opening that is substantially transverse to the longitudinal axis of the main body; and c) a second hook member, wherein the second hook member is positioned adjacent to the distal end of the main body member, wherein the second hook member comprises
   1) a second open end, wherein the second open end opens toward the proximal end of the main body member, and
   2) a second hinged flap, wherein the second hinged flap is operably configured to transition between a closed position and an open position, wherein the second open end of the second hook member is closed when the second hinged flap is in the closed position, wherein when the second hinged flap is in the closed position the second hook member defines a second opening that is substantially transverse to the longitudinal axis of the main body.

2. The electrical extension cord connecting device of claim 1 further comprising an electrical circuit breaker, wherein the electrical circuit breaker is interposed between the male electrical input connectors positioned at the proximal end of the main body member and the female electrical output connectors positioned at the distal end of the main body member.

3. The electrical extension cord connecting device of claim 1 further comprising at least one set of auxiliary female electrical output connectors, wherein the at least one set of auxiliary female electrical output connectors is interposed between the male electrical input connectors positioned at the proximal end of the main body member and the female electrical output connectors positioned at the distal end of the main body member.

4. The electrical extension cord connecting device of claim 3 further comprising at least four sets of auxiliary female electrical output connectors, wherein the at least four sets of auxiliary female electrical output connectors are interposed between the male electrical input connectors positioned at the proximal end of the main body member and the female electrical output connectors positioned at the distal end of the main body member.

5. The electrical extension cord connecting device of claim 4 further comprising an electrical circuit breaker, wherein the electrical circuit breaker is interposed between the male electrical input connectors positioned at the proximal end of the main body member and the female electrical output connectors positioned at the distal end of the main body member.

6. The electrical extension cord connecting device of claim 1 further comprising a lamp, wherein the lamp is interposed between the male electrical input connectors positioned at the proximal end of the main body member and the female electrical output connectors positioned at the distal end of the main body member.

7. The electrical extension cord connecting device of claim 6, wherein the lamp is operable to light when the electrical extension cord connecting device is electrically powered.

8. The electrical extension cord connecting device of claim 6, wherein the lamp comprises a neon lamp.

9. The electrical extension cord connecting device of claim 1, wherein:

a) the first hinged flap is attached to the first hook member via a living hinge; and b) the second hinged flap is attached to the second hook member via a living hinge.

10. The electrical extension cord connecting device of claim 1, wherein the main body member further comprises:

a) a first lip, wherein the first lip is positioned adjacent to the first open end of the first hook member, wherein the first lip is configured to releasably restrain the first hinged flap when the first hinged flap is in the closed position; and b) a second lip, wherein the second lip is positioned adjacent to the second open end of the second hook member, wherein the second lip is configured to releasably restrain the second hinged flap when the second hinged flap is in the closed position.

11. The electrical extension cord connecting device of claim 1, wherein:

a) the first hook member comprises a first back wall, wherein the first back wall comprises a plurality of vertical ribs along at least a portion of the first back wall; and b) the second hook member comprises a second back wall, wherein the second back wall comprises a plurality of vertical ribs along at least a portion of the second back wall.

12. An electrical extension cord connecting device comprising:

a) a main body member, wherein the main body member comprises
   1) a proximal end and an opposite distal end,
   2) a male electrical input connector, wherein the male electrical input connector is positioned at the proximal end of the main body member,
   3) a female electrical output connector, wherein the female electrical output connector is positioned at the distal end of the main body member, and
   (4) an electrical circuit breaker is interposed between the male electrical input connector positioned at the proximal end of the main body member and the female electrical output connector positioned at the distal end of the main body member; and b) an electrical subassembly, wherein the electrical subassembly is configured to electrically connect the male electrical input connector positioned at the proximal end of the main body member to the female electrical output connector positioned at the distal end of the main body member, wherein the electrical subassembly comprises
   1) a cover sheet, wherein the cover sheet comprises a circuit breaker opening,
   2) a top cover, wherein the top cover comprises a circuit breaker housing configured to receive and house at least a portion of the circuit breaker, wherein the circuit breaker housing is configured to be received by the circuit breaker opening in the cover sheet when the top cover and cover sheet are assembled together,
   3) a middle cover,
   4) a bottom cover, and
   5) electric power distribution circuitry positioned among the cover sheet, the top cover, the middle cover, and the bottom cover, wherein the electric power distribution circuitry is configured to electrically connect the proximal end male electrical input connector to the distal end female electrical output connector, wherein the cover sheet, the top cover, the middle cover, and the bottom cover are sized and shaped to be assembled together to house the electric power distribution circuitry;

wherein the electrical subassembly is encapsulated within a molded, unitary, elastomeric, outer body.

13. The electrical extension cord connecting device of claim 12, wherein the electrical subassembly includes at least one least one auxiliary female electrical output connector interposed between the male electrical input connector positioned at the proximal end of the main body member and the female electrical output connector positioned at the distal end of the main body member.

14. The electrical extension cord connecting device of claim 13, wherein the electrical subassembly includes at least four auxiliary female electrical output connectors interposed between the male electrical input connector positioned at the proximal end of the main body member and the female electrical output connector positioned at the distal end of the main body member.

15. The electrical extension cord connecting device of claim 12, wherein the electric power distribution circuitry comprises:

a) a common busbar wire;

b) an active busbar wire; and c) a ground busbar wire.

16. The electrical extension cord connecting device of claim 15 wherein:

a) the common busbar wire is positioned between the bottom cover and the middle cover;

b) the active busbar wire is positioned between the middle cover and the top cover; and c) the ground busbar wire is positioned between the top cover and the cover sheet.

17. The electrical extension cord connecting device of claim 12, further comprising a lamp, wherein the lamp is interposed between the male electrical input connector positioned at the proximal end of the main body member and the female electrical output connector positioned at the distal end of the main body member.

18. The electrical extension cord connecting device of claim 12 wherein the top cover further comprises a first female output connector portion, and wherein the middle cover comprises a second female output connector portion.

19. The electrical extension cord connecting device of claim 18, wherein the bottom cover further comprises at least one hinged socket cover, wherein the hinged socket cover is configured to pivot upward and attach to at least one of the cover sheet, the top cover, and the middle cover thereby encasing the first female output connector portion and the second female output connector portion between the bottom cover and the cover sheet.

20. An electrical extension cord connecting device comprising:

a) a main body member, wherein the main body member comprises 1) a proximal end and a distal end, 2) a male electrical input connector, wherein the male electrical input connector is positioned at the proximal end of the main body member, and 3) a female electrical output connector, wherein the female electrical output connector is positioned at the distal end of the main body member, wherein the male electrical input connector positioned at the proximal end of the main body member is in electrical communication with the female electrical output connector positioned at the distal end of the main body member;

b) a first hook member, wherein the first hook member comprises 1) a first open end, wherein the first open end opens toward the distal end of the main body member, and 2) a first hinged flap, wherein the first hinged flap is operably configured to transition between a closed position and an open position, wherein the first open end of the first hook member is closed when the first hinged flap is in the closed position;

c) a second hook member, wherein the second hook member comprises 1) a second open end, wherein the second open end opens toward the proximal end of the main body member, and 2) a second hinged flap, wherein the second hinged flap is operably configured to transition between a closed position and an open position, wherein the second open end of the second hook member is closed when the second hinged flap is in the closed position; and d) an electrical subassembly, wherein the electrical subassembly is configured to electrically connect the male electrical input connector positioned at the proximal end of the main body member to the female electrical output connector positioned at the distal end of the main body member, wherein the electrical subassembly comprises 1) a cover sheet, 2) a top cover, wherein the top cover comprises a first female output connector portion, 3) a middle cover, wherein the middle cover comprises a second female output connector portion, 4) a bottom cover, wherein the bottom cover comprises a hinged socket cover, wherein the hinged socket cover is configured to pivot upward and attach to at least one of the cover sheet, the top cover, and the middle cover thereby encasing the first female output connector portion and the second female output connector portion between the bottom cover and the cover sheet, and 5) a common busbar wire, wherein the common busbar wire is housed between the bottom cover and the middle cover;

6) an active busbar wire, wherein the active busbar wire is housed between the middle cover and the top cover; and 7) a ground busbar wire, wherein the ground busbar wire is housed between the top cover and the cover sheet.

* * * * *